US006660092B2

(12) United States Patent
Vögel

(10) Patent No.: US 6,660,092 B2
(45) Date of Patent: Dec. 9, 2003

(54) DEVICE FOR APPLYING A COATING AGENT

(75) Inventor: Robert Vögel, Prittriching (DE)

(73) Assignee: Amtec Kistler GmbH, Prittriching (DE)

( * ) Notice: Subject to any disclaimer, the term of this patent is extended or adjusted under 35 U.S.C. 154(b) by 0 days.

(21) Appl. No.: 10/191,373

(22) Filed: Jul. 9, 2002

(65) Prior Publication Data

US 2003/0029938 A1 Feb. 13, 2003

(30) Foreign Application Priority Data

Aug. 11, 2001 (DE) ..... 101 39 633

(51) Int. Cl.[7] ..... B05C 5/00; B05C 11/00; B05B 1/08; B05B 3/06; B05B 1/30

(52) U.S. Cl. ..... 118/684; 118/679; 118/681; 118/687; 118/663; 118/25; 239/101; 239/256; 239/257; 239/533.1; 239/583

(58) Field of Search ..... 239/569, 97, 101, 239/237, 256, 257, 533.13, 533.1, 583, 584, 296, 11; 118/25, 663, 683, 684, 687, 672, 674, 678

(56) References Cited

U.S. PATENT DOCUMENTS

| | | | | | |
|---|---|---|---|---|---|
| 4,566,633 | A | * | 1/1986 | Rinkewich | 239/237 |
| 5,558,716 | A | * | 9/1996 | Mitani et al. | 118/674 |
| 5,707,010 | A | * | 1/1998 | Manfre et al. | 239/296 |
| 5,785,246 | A | * | 7/1998 | King et al. | 239/11 |
| 6,051,070 | A | * | 4/2000 | Sunter | 118/678 |
| 6,379,464 | B1 | * | 4/2002 | Martel | 118/672 |

* cited by examiner

*Primary Examiner*—Kevin Shaver
*Assistant Examiner*—Anuradha Ramana
(74) *Attorney, Agent, or Firm*—Harrison & Egbert

(57) ABSTRACT

With a device for applying a coating agent onto a cyclically moved substrate, a uniform coating thickness may be achieved, although the rate of advance is not constant. At least one spray valve is provided which is permanently supplied with coating agent and the nozzle opening of which being adjustable with regard to the size of its effective discharge area in case of change of the rate of advance of the substrate according to the dependency, for a constant layer thickness of the coating agent, on the discharge rate of the coating agent out of the spray valve on the rate of advance of the substrate.

12 Claims, 2 Drawing Sheets

DEVICE FOR APPLYING A COATING AGENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention refers to a device for applying a coating agent to a cyclically moved substrate, in particular for applying a lubricant to movable sheet metal being supplied to a press in a cycle being adapted to the working cycle of said press.

BACKGROUND OF THE INVENTION

Presses provided with sheet metal manufacture for performing forming processes like deep-drawing processes, work with a certain working cycle. Therefore, the sheet metal must be supplied to such a press in a synchronized cycle. The advance movement of the sheet metal starts with a phase of acceleration and finishes with a phase of deceleration. Inbetween, there may be a period with constant velocity. Therefore, the advance movement is not constant during a step of advance movement.

With the production of deep-drawing moldings, it is known to coat the sheet metal with a lubricant before the deep-draw process for achieving a high surface quality. Spray valves, e.g. of the kind disclosed in DE 94 08 445 U1 of the applicant have been used hereto up to now. With the known spray valves, the discharge rate of the lubricant is constant during the spray process. Therefore, only with a constant rate of advance a lubricant coating having a constant coating thickness may be achieved. However, during the acceleration and deceleration phases decreasing and increasing coating thicknesses, respectively, are achieved which is undesirable. A too thick layer not only results in an unnecessary consumption of lubricant but may also result in an undesired accumulation of lubricant in the area of the deep-drawing devices.

With the spray valve disclosed in the above indicated DE 94 08 445 U1, the stroke of the nozzle needle and therewith the outlet diameter effected by it may be adjusted. However, the respective adjustment remains constant during a coating process. The adjustability of the outlet diameter here only serves for the adaption to different viscosities of different lubricants which are used for different applications. Thus, the disadvantages of the above indicated kind have to be feared here too.

BRIEF SUMMARY OF THE INVENTION

The problem to be solved by the present invention is to provide a device for the application of a coating agent to a cyclically moved substrate, wherein, with a non-constant advance movement of the substrate, a uniform coating thickness of the coating agent may be achieved.

This problem is solved by the combination of claim 1. Hereby a combination of the above indicated kind is proposed which is provided with at least one spray valve which is permanently supplied with coating agent and at least the nozzle opening of which is adjustable with regard to the size of its effective discharge area in case of change of the rate of advance of the substrate according to the dependency, existing for a constant layer thickness, of the discharge rate of the coating agent out of the spray valve on the rate of advance of the substrate.

The area of the nozzle opening belongs to the parameters influencing the discharge rate of the coating agent out of the spray valve, the discharge rate being most influenced by the change of the area of the nozzle opening. Accordingly, the measures according to the invention advantageously result in a dynamic adaption of the discharge rate to the rate of advance of the substrate. By the amendment of the size of the effective discharge area of the nozzle opening according to the invention, the amount of coating agent supplied to the substrate per time unit may be adjusted continuously in such a way that a constant thickness of the coating agent application is achieved. The discharge rate also depends on other parameters, as already indicated, like the viscosity of the coating agent and the pressure of the coating agent at the spray valve. However, the size of the nozzle opening has the largest influence so that advantageously already small changes are sufficient for achieving an adaption of the discharge rate to a varying rate of advance which is advantageous for avoiding undesired standstill times etc. and allows a simple construction. With the inventive measures, with changing rates of advance of the substrate a constant thickness of the coating agent application is achieved for the first time, and therewith the disadvantages mentioned at the beginning are avoided.

Advantageous embodiment and practical modifications of the generic measures are indicated in the claims. Thus, with the use of spray valves having a valve needle cooperating with an associated seat and being lifted from the seat against the force of a closing spring by means of a control medium and contacting a stop, said stop may practically being formed as a rotatable cam which is at least drivable during changing rates of advance of the substrate and comprises a contour being derived from the dependency, existing for a constant thickness of the coating agent layer, of the discharge rate of the coating agent out of the spray valve on the rate of advance of the substrate. The formation of the stop, associated with the valve needle, as a rotatable cam advantageously enables a very simple and cheap construction of a needle stroke adjustment dynamically adapted to the changing rate of advance and therewith to a discharge rate adapted accordingly. The rotational movement of the cam may simply be achieved and controlled.

If several spray valves arranged side by side in line are necessary, the cams associated with them may advantageously be held on a camshaft traversing above all spray valves, said cam shaft being drivable by means of a drive unit controllable by means of a control device. Hereby it is ensured that only one cam drive unit is necessary for all spray valves of one line.

If several spray valves and spray valve lines, respectively, facing each other are necessary which are associated with drive units, said drive units may be controllable by means of the same control device. By this measure the constructional effort may also be reduced and the accuracy increased.

The control device associated with the cam drive unit is practically formed in such a way that at least for one layer thickness information associated with the connection between rate of advance of the substrate and of the cam may be stored in it. The dependency between the rate of advance and the angle position of the cam may thereby simply be stored in the control device in form of a table. The same applies to the course of the advance movement. This facilitates the data collection and supply.

Further advantageous embodiments and practical modifications of the generic measures are indicated in the remaining claims and may be taken from the following description of examples on the basis of the drawings.

DETAILED DESCRIPTION OF THE INVENTION

The principal field of use of the present invention is the deep-drawing forming of sheet metals. Thereby, they are supplied in form of successive plate-like cuttings or in form of an endless strip to a not shown deep-drawing press. The example illustrated in FIG. 1 is based on processing of sheet metal plates.

The sheet metal plates 1 are successively accommodated uniformly spaced from each other on an advancing device 2 which is here formed as a conveyor belt and associated with the not shown deep-drawing press, said advancing device being drivable by means of an associated driving unit 3. With each working cycle of the deep-drawing press one sheet metal plate 1 is formed. The sheet metal plates 1 must therefore be supplied to the deep-drawing press with a cycle which is harmonized with its working cycle. The same applies of course to the advance movement of an endless strip during processing of it.

The driving unit 3 associated with the advancing device 2 is therefore activated and deactivated, respectively, in the desired cycle, the advancing device 2 being first accelerated from standstill to a maximum rate of advance and then again decelerated until standstill. The rate of the advancing movement during a step of advance is accordingly not constant but proceeds over the time according to the diagram shown in FIG. 2 comprising an acceleration phase a, a constant phase b and a deceleration phase c. ; wherein "v" is rate of advance and "t" is time. Between two steps of advance with such a rate of advance a standstill phase d may be provided.

Figure 1:
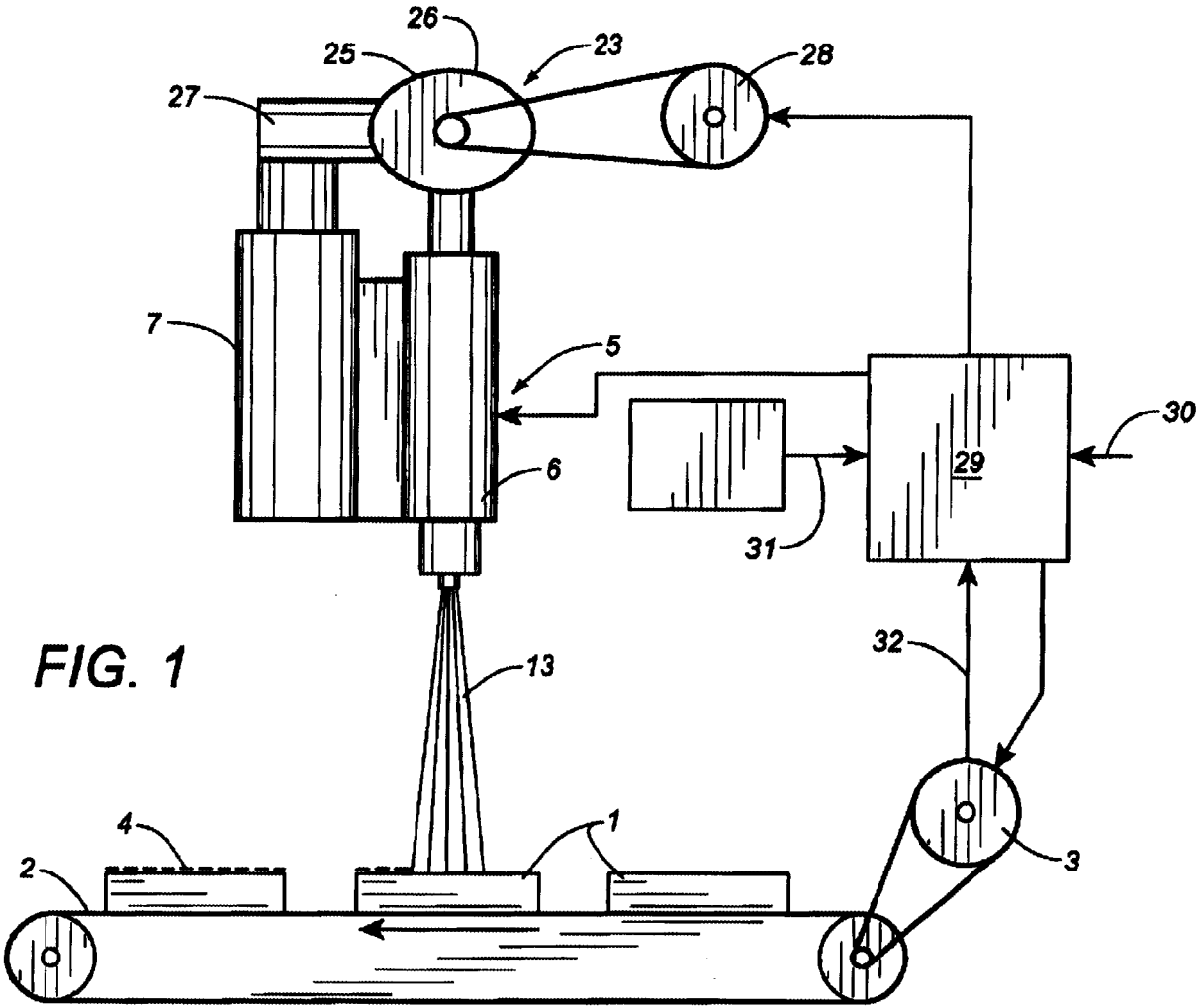
FIG. 1 is a diagrammatic illustration of the application device according to the invention.

The material to be subjected to a deep-drawing process is usually coated on the opposed surfaces with a lubricant forming a coating 4 shown in FIG. 1 by broken lines. For simplification of the illustration in the shown example only the top surface of the sheet metal plates 1 is provided with a lubricant coating 4. In practice, the plates are usually coated on both surfaces.

The coating forming the lubricant application 4 is sprayed by means of an application device 5. The application device 5 comprises at least one spray valve 6. Since with one spray valve 6 generally not the total width of the sheet metal may be coated, usually several spray valves 6 are provided arranged in form of a line traversing the width of the sheet metal, in FIG. 1 only the front valve of said spray valves may be seen. The spray valves 6 arranged side by side are held on a cross bar 7 of a machine framework, not shown, traversing the width of the advancing device 2.

Figure 3:
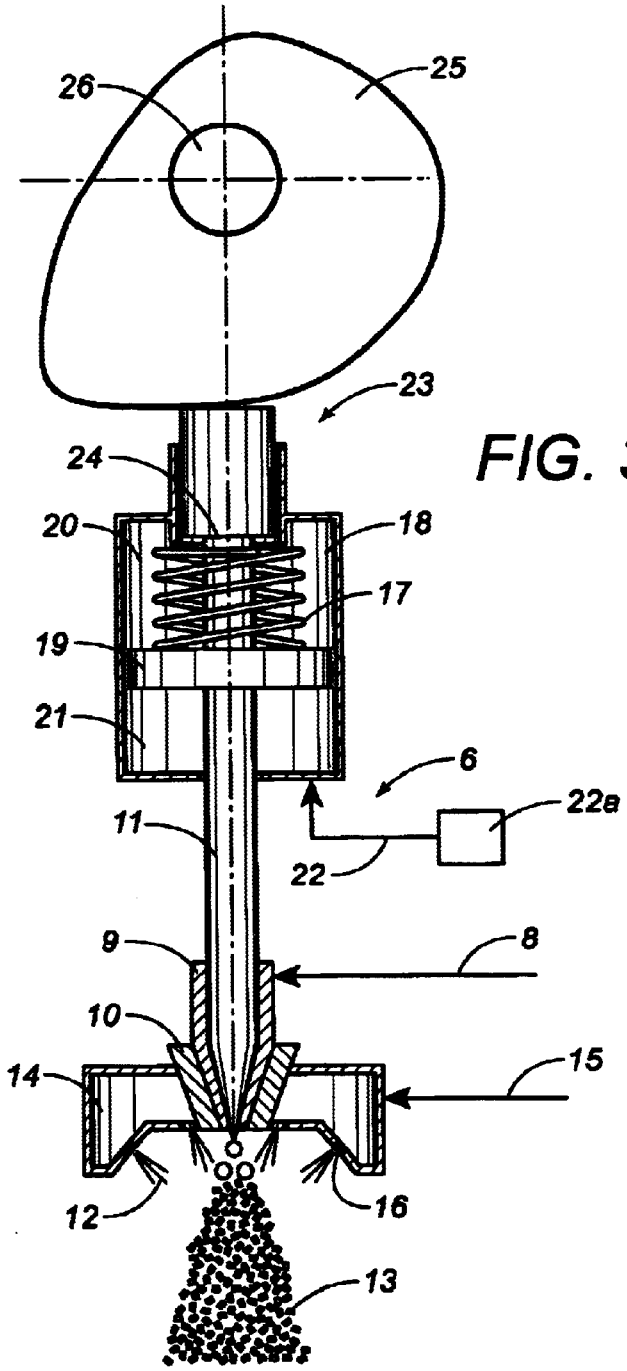
FIG. 3 is a sectional view of a spray valve of the arrangement according to FIG. 1.

The spray valves 6 comprise, as may best be seen from FIG. 3, a chamber 9 which may be charged via a supply line 8 with pressurized lubricant, said chamber 9 having an outlet formed as a conical valve seat 10. A valve needle 11 is associated with the valve seat 10 which may be pressed to the associated seat surface for closing the outlet and which may be lifted from it for opening the outlet. The lubricant supplied to the chamber 9 is constantly pressurized in said chamber 9. As soon as the valve needle 11 is lifted from the associated seat and a nozzle opening with a certain discharge area is accordingly exposed, a lubricant jet ejecting from the chamber 9 is generated. Said jet is atomized by air jets 12 so that a spray jet 13 results being formed by fine lubricant particles. For achieving said atomization a ring chamber 14 is provided surrounding said chamber 9 chargeable with lubricant, said ring chamber 14 being supplied with compressed air via a supply line 15 and comprising several, here obliquely downwardly directed, discharge nozzles 16 for the generation of air jets 12.

The valve needle 11 is pressed by an associated closing spring 17 to the associated valve seat 10. For lifting the valve needle 11 from the associated valve seat 10, the valve needle 11 is provided with a piston 19 arranged within a cylinder 18, said piston separating the interior space of the cylinder 18 into two chambers 20, 21. The closing spring 17 is arranged in the chamber 20 opposite to the valve seat 10 and is supported on the one hand at the piston 19 and on the other hand at the cylinder front wall opposed to it. The chamber 21 near to the valve seat forms a working room which may be supplied with a pressure controlling means, preferably compressed air, via a supply line 22. As soon as said pressure controlling means is provided in the chamber 21, the valve needle 11 is lifted from the valve seat 10 by the force generated hereby and acting upon the piston 19 against the force of the closing spring 17, thereby forming a nozzle opening the discharge area of which corresponds to the area of the ring chamber between the valve seat 10 and the valve needle 11. The above mentioned supply lines 8 and 15 and 22, respectively, may advantageously branch from the associated main lines laid in the cross bar 7 which are provided with appropriate connections.

For limiting the stroke of the valve needle 11 a stroke limiting device 23 is provided. Hereto, the valve needle 11 is provided with a rearward pin 24 surrounded by the closing spring 17, the end of which projecting out of the cylinder 18 being enclosed by a stop and may be contacted with it by the force acting upon the piston 19. For formation of said stop a rotatable cam 25 is provided, the driving unit of which being connected with the driving unit of the advancing device 2 in a certain manner, said cam having a certain contour which is described below in more detail. The cam 25 enables a continuous adjustment of the stroke during operation.

The cams 25 of the spray valves 6 arranged side by side in the form of a line are held on a cam shaft 26 traversing the width of the advancing device 2. Said cam shaft may rest, as may be seen from FIG. 1, onto supports 27 projecting from cross bar 7, resulting in a compact construction. The cam shaft 26 is drivable, as may further be seen from FIG. 1, by means of an associated driving unit 28 which may be controlled by an associated control device 29. The driving unit 28 may be formed as a servo motor with a subsequent gear, preferably a planet gear, having no or less clearance. The control device 29 may be formed as a freely programmable control device comprising a computer and associated memories.

If the substrate formed here by the sheet metal plates 1 is coated as mentioned above from above and below, an upper and a lower application device 5 is provided, the upper and lower cam shaft may be associated with own driving units 28. They are practically controlled by means of a common control device 29. The driving unit 3 associated with the advancing device 2 is practically also controlled by the control device 29. The control device 29 may hereto comprise a control circuit associated with the driving unit 3, the velocity target values may be available as a table. The cyclization is generated by an actuating signal provided by the not shown deep-drawing press, as is indicated by an associated signal input 30 of the control device 29. Of course, it would also be possible to provide the driving unit 3 with an own control device.

The thickness of the coating 4 produced by means of the application device 5 depends on the rate of advance of the advancing device 2 and of the discharge rate of the lubricant out of the spray valve 6, i.e. the lubricant throughput per time unit through the opened nozzle opening. The discharge rate in turn depends on the viscosity of the lubricant, the pressure of the lubricant in the chamber 9, and from the size of the discharge area of the nozzle opening which may be adjusted continuously by the stroke limiting device 23. The pressure and the viscosity shall be constant in the illustrated example. Only the size of the discharge area is changed. Depending on the position of the cam 25 a bigger or smaller discharge area of the nozzle opening results.

The coating 4 shall have a uniform thickness all over. For ensuring this also in the areas of the sheet metal plates 1 passing below the application device 5 during the acceleration phase a and the deceleration phase c, the contour of the cam 25 is formed in such a way that during the acceleration phase a an increase of the effective discharge area of the nozzle opening corresponding to the increase of the velocity and during the deceleration phase c a decrease of the effective discharge area, of the nozzle opening corresponding to the decrease of the velocity results. With the increase and decrease, respectively, of the effective discharge area the discharge rate is accordingly increased and decreased, respectively. Thus, a dynamic adjustment of the discharge rate to the rate of advance results in such a way that the outlet rate during the acceleration phase a increases according to the increase of the velocity and decreases during the deceleration phase c according to the decrease of the velocity so that a coating 4 having a constant thickness is achieved. Thus, the driving velocity of the cam 25 is harmonized in such a way with the contour of the cam that at any time the desired circumferential area of the cam 25 cooperates with the pin 24 of the valve needle 11.

The cam radius associated with the basic position of the cam 25 during the standstill phases d is such that the valve needle 11 is pressed against the associated valve seat 10, and therewith the outlet of the chamber 9 being kept closed. As soon as the driving unit 3 associated with the advancing device 2 is started, the driving unit 28 associated with the cam 25 is also started, the cam 25 being rotated in such a way that the discharge area of the nozzle opening increases. When reaching the maximum rate of advance, i.e. during the constant phase b, the driving unit 28 may be stopped. As soon as the deceleration phase c begins, the driving unit 28 is activated in an opposite direction so that the cam 25 is rotated in such a way that the size of the effective discharge area of the nozzle opening decreases with the rate of advance. At the end of the deceleration phase d, i.e. at the end of the advance movement, the initial position of the cam 25 is again reached with which the spray valve 6 is closed.

The necessary increase and decrease, respectively, of the cam is practically distributed over a circumference of 90°–210°. Thereby, it is ensured that on the one hand the cam increase is not too steep, and on the other hand not too weak, thereby on the one hand undesired accelerations of the valve needle 11 and on the other hand an undesired high driving velocity of the cam 25 may be avoided as well as a smooth continuous adjustment of the needle stroke and therewith a high accuracy may be achieved. The cam standstill during the constant phase ensures that no cam circumference is needed for it and thus, the contour associated with the acceleration and deceleration phase, respectively, may be arranged on a comparably big circumferential area.

Figure 2:
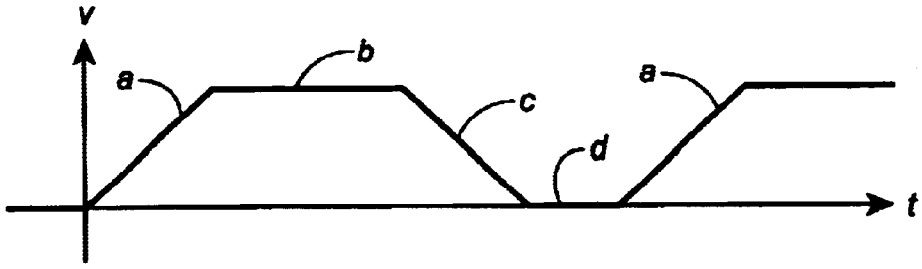
FIG. 2 is a diagrammatic illustration of the velocity of the advancing device of the arrangement according to FIG. 1.

The dependency between the rate of advance following from FIG. 2 and the related angle position of the cam, i.e. the dependency between rate of advance and discharge rate may be stored in form of a table in the control device 29 as is indicated in FIG. 1 by an appropriate input 31. In the same way, the velocity diagram of the advance movement may simply be stored in the control device 29 and may be used for calculation of the desired angle position of the cam 25. This may be applied if the advance movement always takes the same course. However, for achieving an especially high accuracy, it is advantageous to detect the actual value of the advance rate, as is indicated by an appropriate actual value input 32 of the control device 29, and to determine from said actual value of the velocity by means of a stored table of angles the associated position of the cam.

Further aggregates contributing to the coating process, preferably the compressed air supply of the ring chamber 14 supplying the air jets 12, may also be controlled by the control device in addition to the driving units 28 and 3. For reducing the consumption of compressed air the supply of compressed air to the ring chamber 14 during the standstill phases d may be turned off. The supply of pressure controlling means 22*a*, of the working chamber 21 associated with the piston 19 may also be turned of during the standstill phases d. These measures are advantageously used if the standstill phase d is longer than a certain minimum value. For achieving a high degree of accuracy, the supply of the working chamber 21 and of the ring chamber 14, respectively, must again be activated in advance, preferably 100 milliseconds in advance, before the beginning of the next advance movement. The control device 29 accordingly comprises appropriate memories for the reception of the necessary information and connections.

In the illustrated embodiment only the size of the effective discharge area of the nozzle opening is continuously changed dynamically adapted to the rate of advance. It would also be possible to change one or several of the further parameters influencing the discharge rate dynamically adapted to the rate of advance. However, the largest influence has a change of the size of the effective discharge area of the nozzle opening so that with a device of the kind described above good results may be achieved in a simple manner.

I claim:

1. A device for applying a coating agent to a cyclically moved substrate comprising:

at least one spray valve having an inlet, said inlet for supplying the spray valve with the coating agent, the spray valve having a nozzle opening means for adjusting a discharge rate of the coating agent out of the spray valve based on a rate of advance of the substrate, said nozzle opening means being adjustable relative to a size of a discharge area thereof, the nozzle opening means comprising:

a valve seat;

a valve needle cooperative with said valve seat;

a doing spring means cooperative with said valve needle for lifting said valve needle from said valves at, said valve needle resiliently contacting a stop against a force of said closing spring means, said stop comprising a rotatable cam having a contour cooperative with said valve needle, said contour corresponding to a desired discharge rate of the coating agent out of the spray valve based upon the rate of advance of the substrate;

a driving means drivingly connected to said cam for rotating said cam; and a control means interactive with said driving means, said control means for determining the rate of advance of the substrate and for determining a desired angular position of said cam relative to the rate of a vance, and control means for actuating said driving means so as to rotate said cam to the desired angular position.

2. The device of claim 1, said control means having a memory means associated therewith, said memory means for storing information as to the desired angular position of the cam relative to the rate of advance of the substrate for at least one desired layer thickness of the coating agent.

3. The device of claim 2, the information corresponding to a course of the rate of advance of the substrate.

4. The device of claim 1, said control means for setting an actual input value for the rate of advance of the substrate.

5. The device of claim 1, further comprising:

an advancing means for receiving the substrate; and a cyclical processor arranged sequentially to said advancing means, said cyclical processor for transmitting actuating signal to said control means, said advancing means being actuatable by said control means for advancing the substrate therefrom.

6. The device of claim 1, said at least one spray valve comprising a plurality of spray valves arranged side-by-side in a line, each of said plurality of spray valves having said cam cooperative therewith, the cams being supported by a cam shaft extending across said plurality of spray valves, said driving means for rotating said cam shaft.

7. The device of claim 6, said cam shaft resting on a cross bar, said plurality of spray valves being mounted to said cross bar.

8. The device of claim 7, each of said plurality of spray valves having a supply line extending therefrom, said supply line laying in said cross bar.

9. The device of claim 6, said driving means comprising a servo motor.

10. The device of claim 9, said driving means further comprising a gear assembly connected between said servo motor and said cam shaft.

11. The device of claim 1, said at least one spray valve comprising a plurality of spray valves in opposed relation, the cam for each of said plurality of spray valves being supported by a cam shaft, said driving means or rotating each of the cam shafts.

12. The device of claim 11, further comprising:

a pressure controlling means cooperative with the spray valve and actuatable by said control means for turning off a supply of the coating agent when a predetermined minimum time of standstill time of the rate of advance of the substrate has been exceeded.

* * * * *